US005560512A

United States Patent [19]

Hahn

[11] Patent Number: 5,560,512

[45] Date of Patent: Oct. 1, 1996

[54] ANTI-SCAVENGING DEVICE FOR USE WITH RECEPTACLES

[76] Inventor: Hoon Hahn, 4226 Keystone Ave., Culver City, Calif. 90230

[21] Appl. No.: 296,680

[22] Filed: Aug. 26, 1994

[51] Int. Cl.[6] ..... B65D 43/06

[52] U.S. Cl. ..... 220/334; 206/366; 206/370; 220/256; 220/259; 220/337; 220/343; 220/908; 232/47; 232/48; 232/57; 232/60; 232/62

[58] Field of Search ..... 220/212, 256, 220/259, 334, 337, 343, 908; 206/366, 370; 232/47, 48, 52, 57, 60, 62; 137/38, 43

[56] References Cited

U.S. PATENT DOCUMENTS

| | | | |
|---|---|---|---|
| 1,322,522 | 11/1919 | Bixon | 232/47 |
| 1,567,894 | 12/1925 | Barcelona | 232/43.1 |
| 2,998,897 | 9/1961 | Rudder et al. | 232/62 |
| 3,938,692 | 2/1976 | Crute | 137/43 X |
| 4,261,485 | 4/1981 | Borg | 137/38 |
| 5,080,251 | 1/1992 | Noack | 220/335 |

*Primary Examiner*—Allan N. Shoap
*Assistant Examiner*—Robin A. Hylton
*Attorney, Agent, or Firm*—Darby & Darby P.C.

[57] ABSTRACT

An anti-scavenging device for deterring scavenging of goods from collection bins and receptacles, includes a frame mounted in an opening of a collection bin and a blocking member moveable between one position limiting access to the interior of the bin when the bin is positioned substantially upright, and another position blocking the opening when the bin is substantially inverted. In the preferred embodiment, the blocking member comprises two angularly-offset angular portions which freely drop into the two positions as facilitated by sliding supports engaging the frame. The blocking member are provided with supports to engage the frame, the supports being specially configured to prevent the blocking member from pivoting or tilting about its central axis as it moves between the two positions. Stabilizing bars may also be provided to maintain overall configuration of the frame.

24 Claims, 3 Drawing Sheets

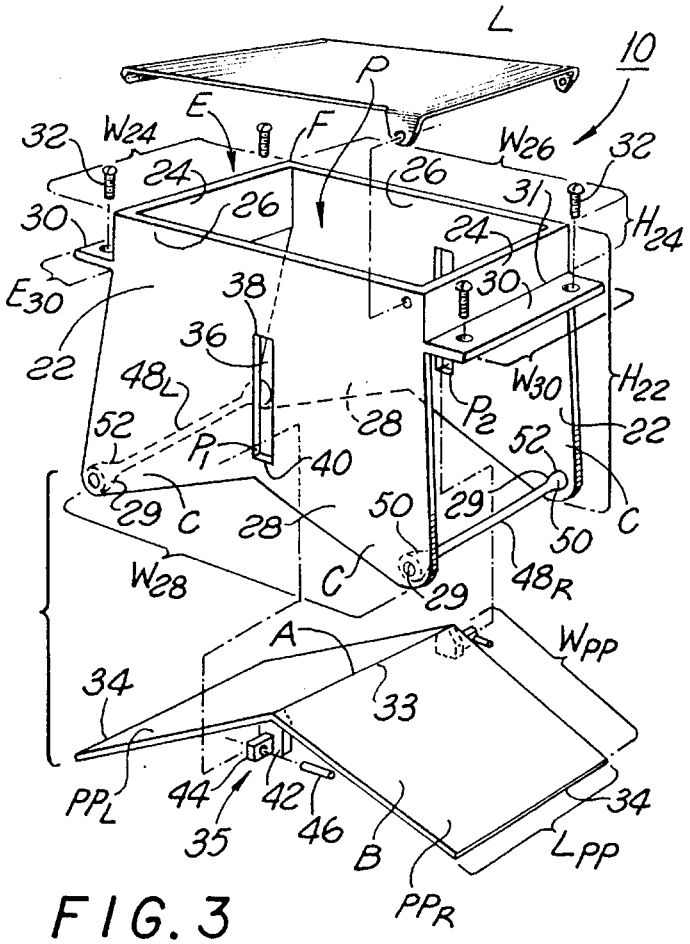
FIG. 3
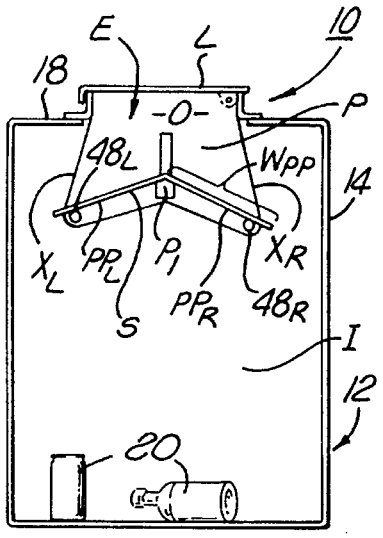
FIG. 4
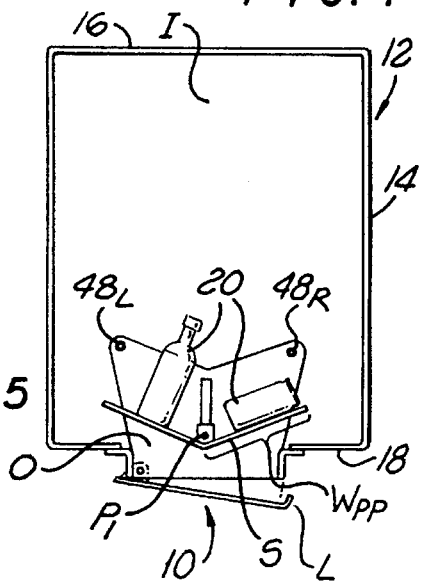
FIG. 5
FIG. 6
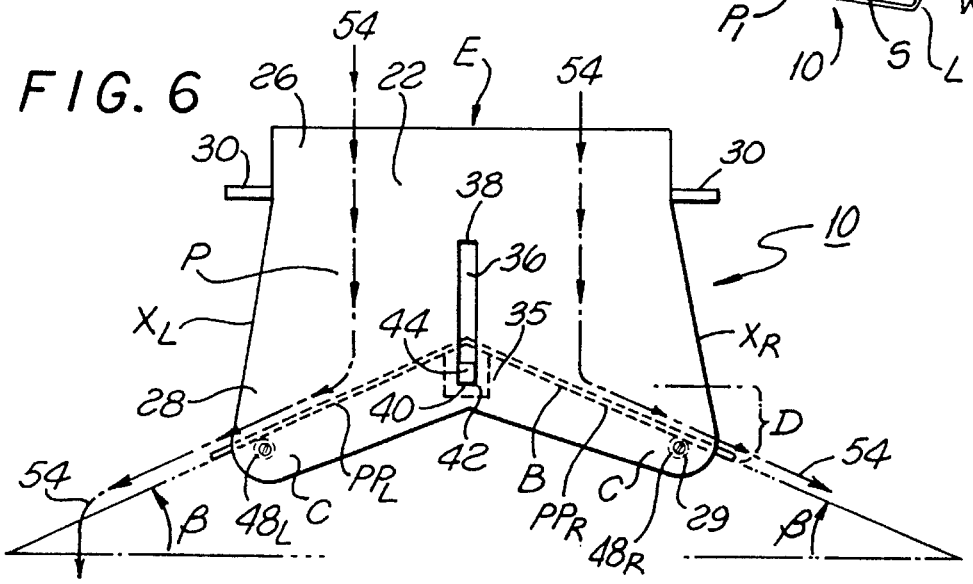

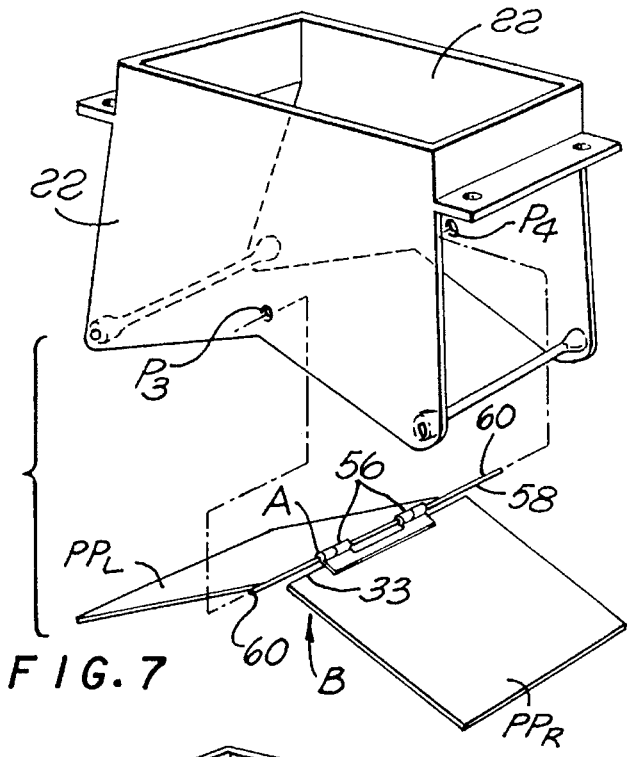
FIG. 7
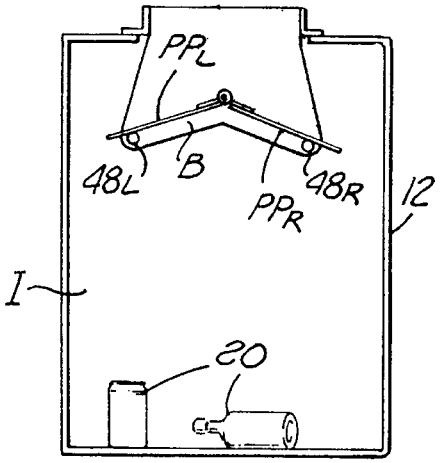
FIG. 8
FIG. 9
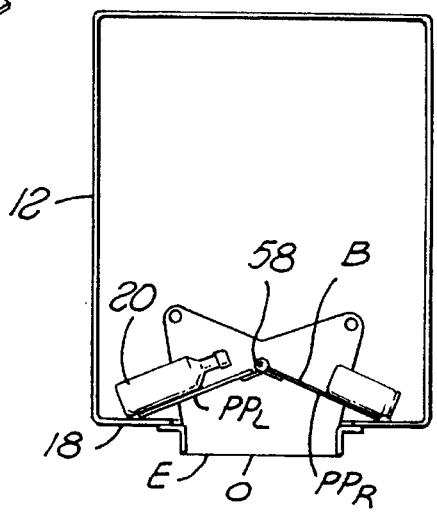
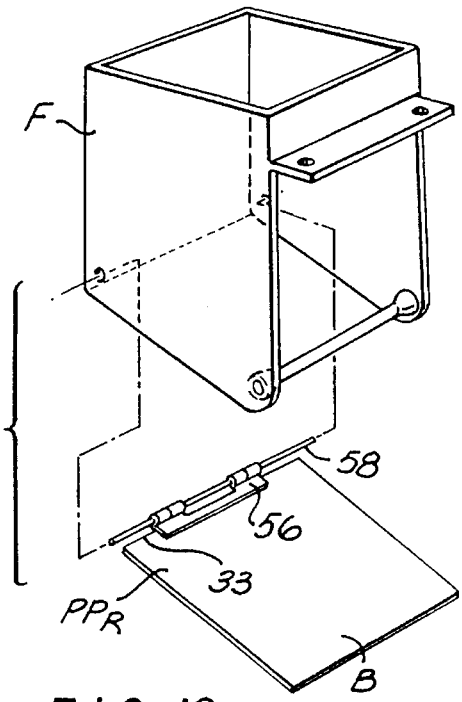
FIG. 10
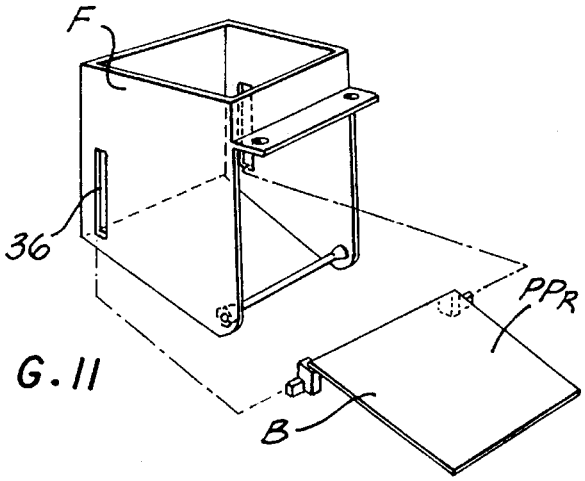
FIG. 11

ANTI-SCAVENGING DEVICE FOR USE WITH RECEPTACLES

FIELD OF THE INVENTION

This invention relates generally to collection bins or receptacles, in particular, to a device deterring scavenging of goods deposited in collection bins or receptacles.

BACKGROUND AND SUMMARY OF THE INVENTION

In recent years, the volume of garbage has raised serious concern. In particular, considerable attention has been given to the adverse effects of garbage on the environment. As part of various growing efforts addressing this problem, recycling garbage appears most effective and popular.

For years, numerous organizations have implemented programs promoting recycling, including the installation of bins at public sites, such as supermarkets and malls, to collect recyclable constituents of trash, such as paper, glass, plastic and aluminum. Currently, there exists an extensive recycling industry involving both private businesses and government entities. Beyond voluntary participation in recycling programs, local governments may soon, if not already, be mandated under federal and state legislation to implement recycling programs. Of those municipalities presently participating in recycling programs, many provide specially-marked recycling bins or crates to collect recyclable goods. In addition to reducing the volume of garbage, these recycling programs have also generated substantial revenue for participating municipalities.

Where selected recyclable goods are redeemable for cash, there is great incentive for individuals to raid recycling bins. Such scavenging activity is undesirable for numerous aesthetic and financial reasons, including significant loss of recyclable goods and damage to recycling bins.

Conventional collection bins and receptacles typically have large and unobstructed openings facilitating deposit of recyclable goods. Where the openings are covered by lids, the lids are often easily lifted or otherwise displaced. While such large openings facilitate deposit of recyclables, they also facilitate removal of deposited recyclables, allowing scavenging. With conventional collection bins, individuals can easily insert an arm through the openings and remove selected items. Sometimes, the bins are simply inverted and the goods are unloaded from the bins through the openings.

As another consideration, library books, food items and toys may also be collected for various purposes. Conventional bins also allow these items to be scavenged, with selected items taken and remaining items damaged.

Accordingly, there exists a demand for a device to deter, if not prevent, individuals from scavenging collection bins and receptacles. In accordance with the present invention, an anti-scavenging device is provided to hinder individuals from rummaging and removing deposited goods from a collection bin. The anti-scavenging device comprises a frame mounted in an opening of a collection bin, the frame defining a passage through the opening, between an entrance from outside the bin and an exit into an interior of the bin. The anti-scavenging device includes a blocking member moveable between one position limiting access to the interior of the bin when the bin is positioned substantially upright, and another position blocking the opening when the bin is substantially inverted.

These, as well as other features of the invention, will become apparent from the detailed description which follows, considered together with the appended drawings.

DESCRIPTIONS OF THE DRAWINGS

In the drawings, which constitute a part of this specification, exemplary embodiments demonstrating various features of the invention are set forth as follows:

FIG. 3 is an exploded view of the preferred embodiment of the invention;

FIG. 4 is a view of the preferred embodiment of FIG. 1 taken along line 8—8;

FIG. 5 is a view of the preferred embodiment of FIG. 2 taken along line 9—9;

FIG. 6 is a side elevation view of the preferred embodiment of FIG. 3;

FIG. 7 is an exploded view of an alternative embodiment of the invention;

FIG. 8 is a sectional view of the alternative embodiment of FIG. 7 and the collection bin of FIG. 1, where the collection bin is substantially upright;

FIG. 9 is a sectional view of the alternative embodiment of FIG. 7 and the collection bin of FIG. 1, where the collection bin is substantially inverted;

FIG. 10 is an exploded view of another alternative embodiment of the invention; and FIG. 11 is an exploded view of yet another alternative embodiment of the invention.

DESCRIPTION OF THE ILLUSTRATIVE EMBODIMENTS

As indicated above, detailed illustrative embodiments are disclosed herein. However, systems for accomplishing the objectives of the present invention may be detailed quite differently from the disclosed embodiments. Consequently, specific structural and functional details disclosed herein are merely representative; yet, in that regard, they are deemed to afford the best embodiment for purposes of disclosure and to provide a basis for the claims herein which define the scope of the present invention.

Figure 1:
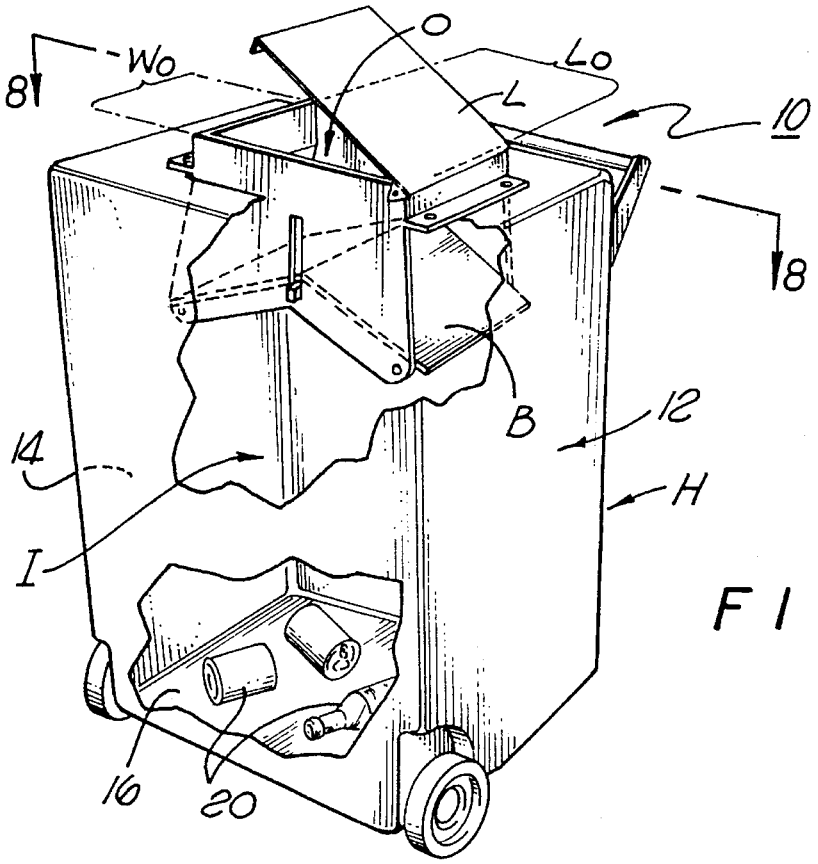
FIG. 1 is a perspective view illustrating a preferred embodiment of the invention secured to a collection bin, where the collection bin is substantially upright.
Figure 2:
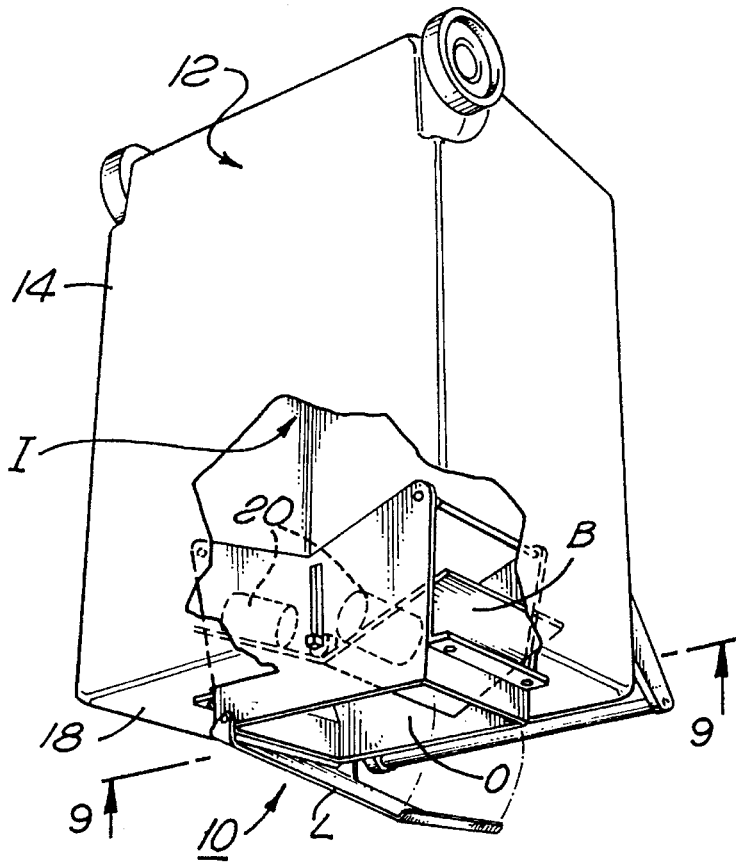
FIG. 2 is a perspective view illustrating the preferred embodiment of the invention and the collection bin of FIG. 1, where the collection bin is substantially inverted.

Referring to FIGS. 1 and 2, an anti-scavenging device 10 is provided for use with a collection bin or receptacle 12. As shown, the bin 12 may include a lid L which may be variously affixed to the bin 12. The bin 12 may be oriented in numerous positions, including an upright position (FIG. 1) or an inverted position (FIG. 2). The bin 12 is enclosed by a housing H with side panels 14, a bottom panel 16 and a lid or top panel 18, together defining an interior I for storing items 20, such as recyclable cans, bottles, and the like. The top panel 18 of the bin 12 provides an opening O through which the items 20 are deposited into the bin 12. For example, the opening O may be rectangular, approximately 9.5 inches in width (bracket $W_O$) by 10.5 inches in length (bracket $L_O$). As such, the opening O may accommodate the larger items 20, such as plastic milk cartons.

The anti-scavenging device 10 is mounted to the top panel 18 and positioned in the opening O to hinder rummaging and/or removal of the items 20 from the interior I of the bin 12. In particular, the anti-scavenging device 10 provides a blocking member B moveable between two positions depending on the orientation of the bin 12. For example, the blocking member B may limit access to the interior I when the bin 12 is substantially upright or substantially block the opening O to confine the items 20 in the bin 12 when the bin 12 is substantially inverted.

Referring now to FIG. 3, the anti-scavenging device 10 comprises a frame F having opposing main panels 22 and elongate side panels 24. Upper portions 26 of the main panels are connected by the elongate side panels 24 extending therebetween at substantially right angles thereto. The main panels 22 may be substantially trapezoidal, the upper portion 26 being relatively narrower than lower portions 28. The lower portions 28 have opposing tapered corners C providing bores 29.

For example, the upper portions 26 of the main panels 22 may be approximately 10 inches wide (bracket $W_{26}$) between the elongate side panels 24, and the lower portions 28 may be approximately 12 inches wide (bracket $W_{28}$) between the corners C. The main panels 22 may be approximately 12 inches in height (bracket $H_{22}$) between the upper portions 26 and the lower portions 28. Also, the elongate side panels 24 may be 9 inches wide (bracket $W_{24}$) between the main panels 22, and 3 inches in height (bracket $H_{24}$).

Flanges 30 are further provided on the elongate side panels 24, extending outwardly from bottom edges 31 of the elongate side panels 24. The flanges 30 are approximately 9 inches wide (bracket $W_{30}$) substantially between the main panels 22 and extend approximately 2 inches over the top panel (bracket $E_{30}$) (FIG. 1) for receiving fasteners 32 securing the device 10 to the bin 12.

Since the frame F is positioned in the opening O, the frame F must be configured to fit in the opening O. Although described with distinct panels and flanges, the frame F may be constructed from substantially one continuous piece of material.

To facilitate the deposit of items 20 into the bin 12, the frame F defines a passage P through the opening O, extending between an entrance E from outside the bin 12 and an exit X (not shown) into the interior I of the bin 12. The entrance E is substantially defined by the elongate side panels 24 and the upper portions 26 of the main panels 22 positioned above the top panel 18 of the bin 12. The exit X is substantially defined by the flanges 30 and the lower portions 28 of the main panels 22.

To deter and/or prevent individuals from raiding the bin 12, the blocking member B is movable between two positions in accordance with the orientation of the bin 12. If the bin 12 is substantially upright, the blocking member B rests in a first position substantially limiting access to the interior I of the bin, as shown in FIGS. 1 and 4. If the bin 12 is substantially inverted, the blocking member B rests in a second position substantially confining the items 20 to the interior I of the bin 12, as shown in FIGS. 2 and 5.

In one disclosed embodiment clearly illustrated in FIG. 3, the blocking member B is substantially horizontal and includes two angularly-offset planar portions or wings $PP_R$ and $PP_L$ rigidly joined at abutting edges 33 forming a ridge A. The planar portions $PP_R$ and $PP_L$ may be rectangular and are, for example, approximately 7 inches (bracket $W_{PP}$) between edges 34 and the ridge A, and 8.75 inches transversely thereto (bracket $L_{PP}$). The planar portions $PP_L$ and $PP_R$ being offset are sloped downwardly from the ridge A and define an angle β, for example, 26 degrees from the horizontal (FIG. 6). The sloped configuration of the planar portions $PP_L$ and $PP_R$ facilitates the deposit of items 20 into the bin 12, as the items 20 readily slide down the blocking member B into the interior I of the bin 12.

To enable the blocking member B to move between the first and second positions in accordance with the orientation of the bin 12, the blocking member B is movably engaged with the frame F at two points $P_1$ and $P_2$ on the main panels 22. As the blocking member B moves between the first and second positions, the points $P_1$ and $P_2$ move accordingly. Various mechanisms well known in the art may be employed at the two points $P_1$ and $P_2$. In the disclosed embodiment shown in FIG. 3, a pair of supports 35 is provided on the blocking member B at opposing ends of the ridge A for engaging vertical slots 36 provided in the main panels 22. The vertical slots 36 are positioned centrally in the main panels 22 and may be 0.75 inches wide by 6.5 inches long between upper ends 38 and lower ends 40. In accordance with the angle β, the significance of which is clarified below, the lower ends 40 of the vertical slots 36 are positioned a selected distance D above the bores 29 (FIG. 6).

The supports 35 include a base 42 and a stem or arm 44 to engage the vertical slots 36. The stems 44 slide along the vertical slots 36 between the ends 38 and 40 as the blocking member B moves between the first and second positions. In the first position (FIG. 1), the blocking member B is adjacent the lower portions 28 of the main panels 22. In the second position (FIG. 2), the blocking member B is adjacent the side panels 24 and the upper portions 26 of the main panels 22.

In the embodiment of FIG. 3, the blocking member B simply drops into the first position by its own weight when the bin 12 is substantially upright (FIG. 1) and likewise, simply drops into the second position by its own weight when the bin 12 is substantially inverted (FIG. 2). To that end, the supports 35 may provide additional weight to aid the movement of the blocking member B between the first and second positions.

As clearly shown in FIG. 3, the stems 44 may have a substantially vertically-elongated cross-section, for example, a rectangular cross-section having a height of approximately 0.8 inches and a width of approximately 0.5 inches. As such, the stems 44 when engaged with the vertical slots 36 enable the blocking member B to move smoothly between said first and second positions, while remaining in alignment with the vertical slots 36 to prevent the blocking member B from pivoting about the points $P_1$ and $P_2$.

Stabilizers 46 may also be provided on the stems 44 of the supports 35 to aid the movement of the blocking member B. The stabilizers 46 may include bolts, screws, or the like, protruding transversely from the stems 44 to prevent the stems 44 from disengaging with the vertical slots 36, as well as, to further increase the weight of the supports 35.

As an alternative to the base 42, the stems 44 and the vertical slots 36, slide bearings and guide channels well known in the art may be provided on the blocking member B and the main panels 22, respectively, to facilitate movement of the blocking member B between the first and second positions.

Referring also to FIG. 4, to stabilize and support the blocking member B in the first position, a pair of stabilizing bars or rods $48_R$ and $48_L$ are provided to extend between the opposing main panels 22 at the corners C. To that end, the stabilizing bars $48_R$ and $48_L$ are approximately 10 inches in length with ends 50 inserted through the bores 29 in the corners C. Having somewhat bulbous portions 52 at the ends 50 to maintain separation between the main panels 22, the stabilizing bars $48_R$ and $48_L$ prevent the corners C from curling inwardly, deforming the lower portions 28 of the main panels 22 and obstructing the movement of the blocking member B.

As mentioned earlier, the positions of the bores 29 relative to the lower end 40 of the vertical slots 36 correspond to the angle β such that the lower ends 40 are positioned the distance D above the bores 29. This configuration enables the planar portions $PP_R$ and $PP_L$ to rest on the stabilizing bars $48_R$ and $48_L$ while the blocking member B is in the first position, provided that the planar portions $PP_R$ and $PP_L$ along the width $W_{PP}$ extend beyond the stabilizing bars $48_R$ and $48_L$, respectively. In this respect, the stabilizing bars $48_R$ and $48_L$ further prevent the blocking member B from pivoting in either the clockwise or counterclockwise direction about the points $P_1$ and $P_2$ while in the first position.

Referring also to FIG. 5, where the blocking member B in the second position, it is recognized that the planar portions $PP_R$ and $PP_L$ along the width $W_{PP}$ may extend beyond the opening O. As such, the top panel 18 further prevents the blocking member B from pivoting significantly in either the clockwise or counterclockwise direction about the points $P_1$ and $P_2$ while in the second position.

As shown in FIGS. 4 and 6, the blocking member B attains the first position when the bin 12 is substantially upright. With the blocking member B in the first position, the stems 44 rest on the lower ends of the vertical slots 36 and the planar portions $PP_R$ and $PP_L$ rest on the stabilizing bars $48_R$ and $48_L$, respectively. So positioned, the blocking member B divides the exit X into two opposing side exits $X_R$ and $X_L$, each substantially defined by one of the planar portions $PP_R$ and $PP_L$ at the bottom and the adjacent flange 30 at the top. As the items 20 are deposited into the bin 12, the items 20 enter the device 10 through the entrance E, slide down through the passage P on the planar portions $PP_R$ and $PP_L$ sloped at the angle β and exit into the interior I through the exits $X_R$ and $X_L$. Contrary to an item travelling a substantially linearly downward path when dropped into a conventional bin, the item 20 when dropped into bin 12 with the device 10 travels a substantially nonlinear path 54 to reach the interior I.

If a person attempts to remove the items 20 from the upright bin 12, the person is prevented from simply lifting the items 20 out of the bin 12 because access to the interior I is significantly limited by the blocking member B. For example, if the person extends an arm into the bin 12, the person cannot pivot the blocking member B to reach linearly downward into the interior I of the bin 12. In particular, if the person is positioned to the left of the bin 12 and inserts an arm from the entrance E toward the side exit $X_R$, the stems 44 and/or the stabilizing bar $48_R$ prevents the blocking member B from pivoting in the clockwise direction toward the interior I. If the person inserts the arm toward the side exit $X_L$, the stems 44 and/or the stabilizing bar $48_L$ prevents the blocking member B from pivoting in the counterclockwise direction toward the interior I. In both instances, the person is unable to reach directly into the interior I of the bin 12, but is forced to position his arm substantially along the path 54 in order to rummage or remove the items 20. To that end, it is recognized that the device 10 and the bin 12 must be configured in accordance with dimensions of an average-sized person. Furthermore, where the device 10 is constructed of an opaque material, the scavenging activities of the person is further hindered as visibility of the interior I is severely limited especially by the blocking member B. Thus, even where the person is using tongs or other tools to extend his reach, the person cannot readily see into the interior I of the bin 12.

Referring to FIG. 5, if the person inverts the bin 12 in attempting to unload the items 20 from the opening O, the blocking member B moves into the second position blocking the opening O. With the blocking member B in the second position, the stems 44 rest on the top end 38 of the vertical slots 36. If the person attempts to pivot the blocking member B about the points $P_1$ and $P_2$ in either the clockwise or counterclockwise direction, the stems 44 and/or the top panel 18 blocks the planar portions $PP_R$ and $PP_L$ from pivoting significantly. If the person attempts to push the blocking member B upwardly, moving the supports 35 toward the lower end 38, the person is forced to push against the weight of blocking member B and the items 20 in the interior I that have fallen onto the blocking member B.

Even if the person orients the bin 12 laterally, it can be seen that access to the interior I is significantly limited to the path 54 by the blocking member B, the stabilizing bars $48_R$ and $48_L$ and the top panel 18. Accordingly, rummaging and/or removal of items 20 from the bin 12 is still severely hampered.

Referring to FIGS. 7, 8 and 9 illustrating an alternative embodiment of the present invention, the planar portions $PP_R$ and $PP_L$ are joined by hinges 56 along the edges 33 for enabling the planar portions to separately pivot about the ridge A. The blocking member B is fixedly fastened to the main panels at points $P_3$ and $P_4$ by a shaft 58 inserted through the hinges 56 and mounted at its ends 60 to the main panels 22. Accordingly, the blocking member B attains the first position (FIG. 8) when the bin 12 is substantially upright, and a third position (FIG. 9) when the bin 12 is substantially inverted. As indicated, the first position of the blocking member B limits access to the interior I of the bin 12, where the planar portions $PP_R$ and $PP_L$ rest on the stabilizing bars $48_R$ and $48_L$, respectively. However, the third position enables the blocking member B to substantially block the opening O in a manner slightly different from the second position described above. In particular, where the bin 12 is inverted, the shaft 58 remains stationary relative to the main panels 22 and does not move toward the entrance E. Instead, the planar portions $PP_R$ and $PP_L$ pivot clockwise and counterclockwise, respectively, about the shaft 58 by their own weight to rest against the top panel 18. As such, the blocking member B blocks the opening O to substantially confine the items 20 to the bin 12.

Referring to FIG. 10 illustrating a further alternative embodiment of the present invention, the embodiment of the device 10 of FIG. 7 is substantially halved. For example, the right portion of the frame F and the blocking member B remain, with the planar portion $PP_R$ hinged to the shaft 58 by the hinges 56 along the edges 33.

Referring to FIG. 11 illustrating yet another alternative embodiment of the present invention, the embodiment of the device 10 of FIG. 1 is substantially halved. For example, the right portion of the frame F and the blocking member B remain, with the planar portion $PP_R$ slidably engaging the vertical slots 36.

It may be seen that the system of the present invention may be readily incorporated in various embodiments to provide an anti-scavenging device. The various components and dimensions disclosed herein are merely exemplary, and of course, various alternative techniques may be employed departing from those disclosed and suggested herein. For example, the configurations of the frame and the blocking member may be varied so long as access to the interior of the bin is substantially blocked. To that end, the frame need only provide areas where the blocking member may be attached. Also, the height of the elongate side panels may be varied, or the flanges may extend outwardly from top edges of the elongate side panels rather than the bottom edges to be flush with the entrance of the device. Also, the fasteners may include relatively permanent structures such as glue or nails, or releasable fasteners requiring some effort, such as bolts or screws. Moreover, the device and the collection bin may substantially be constructed from a singular piece of construction, thus obviating the need for the flanges and the fasteners.

Consequently, it is to be understood that the scope hereof should be determined in accordance with the claims as set forth below.

What is claimed is:

1. An anti-scavenging device comprising:

a frame defining an opening for collecting objects in a collection bin;

a blocking member movably attached to said frame; and engaging means for enabling said blocking member to remain engaged with said frame while moving along in a substantially linear direction between a first position when said collection bin is substantially upright to prevent linear access into said collection bin and a second position when said collection bin is substantially inverted to block access into said collection bin.

2. An anti-scavenging device in accordance with claim 1, wherein said engaging means comprises vertical slots positioned in said frame and said blocking member comprises stems to engage said vertical slots.

3. An anti-scavenging device in accordance with claim 1, further comprising means for maintaining alignment of said blocking member relative to said frame.

4. An anti-scavenging device in accordance with claim 1, further comprising at least one rod extending across said frame to maintain configuration of said frame.

5. An anti-scavenging device in accordance with claim 1, wherein said blocking member in said first position is positioned a greater distance from said opening and said blocking member in said second position is positioned a lesser distance from said opening.

6. An anti-scavenging apparatus in accordance with claim 1, wherein said blocking member limits visibility of an interior of said collection bin.

7. An anti-scavenging device in accordance with claim 1, wherein said blocking member comprises at least one planar portion.

8. An anti-scavenging device in accordance with claim 7, wherein said blocking member further comprises another planar portion and said planar portions are rigidly joined at commonly abutting edges.

9. An anti-scavenging device in accordance with claim 7, wherein said blocking member comprises two planar portions defining a commonly abutting edge, said planar portions being pivotable about said edge.

10. An anti-scavenging device comprising:

a stationary frame defining an opening through which items are deposited into an interior of a bin;

a blocking member having at least one section movably engaging said frame for movement between a first position when said bin is substantially upright and a second position when said bin is substantially inverted; and a stabilizing rod extending between said blocking member and said frame to provide a surface on which said blocking member rests in said first position, said stabilizing rod being free from all contact with said blocking member when said bin is substantially inverted.

11. An anti-scavenging device in accordance with claim 10, wherein said blocking member in said first position is disposed a greater distance from said opening to divert a path of an item deposited in said bin and said blocking member in said second position is disposed a lesser distance from said opening to block access to said interior.

12. An anti-scavenging device in accordance with claim 10, wherein said stabilizing rod is fixed to said frame.

13. An anti-scavenging device in accordance with claim 10, further comprising means for maintaining configuration of said frame.

14. An anti-scavenging apparatus in accordance with claim 10, further comprising pivoting means for enabling said blocking member to pivot between said positions.

15. An anti-scavenging device in accordance with claim 10, wherein said blocking member comprises a portion diverting paths of said items.

16. An anti-scavenging device in accordance with claim 15, wherein said blocking member further comprises another portion and said portions are pivotally joined at commonly abutting edges.

17. An anti-scavenging device in accordance with claim 15, wherein said portion is pivotable about one edge of said portion.

18. An anti-scavenging apparatus comprising:

a receptacle having an interior cavity;

a blocking member positioned relative to said receptacle to be movable between a first position when said receptacle is upright and a second position when said receptacle is inverted; and sliding means for enabling said blocking member to slide along in a substantially linear direction between said positions.

19. An anti-scavenging apparatus in accordance with claim 18, wherein said sliding means slidably engages said blocking member to said receptacle.

20. An anti-scavenging apparatus comprising:

a receptacle having an interior cavity;

a blocking member positioned relative to said receptacle to be movable along in a substantially linear direction between a first position when said receptacle is upright and a second position when said receptacle is inverted; and a stabilizing member configured to come into contact with said blocking member when said receptacle is upright and to be free from contact with said blocking member when said receptacle is inverted.

21. An anti-scavenging apparatus comprising:

a receptacle having an interior cavity;

means for limiting access to said interior cavity being movable between a first position when said receptacle is upright and a second position when said receptacle is inverted, said means for limiting access defining multiple nonlinear accesses into said interior cavity when said means for limiting access is in said first position, said means for limiting access being movable relative to said receptacle along in a substantially linear direction.

22. An anti-scavenging apparatus in accordance with claim 21, further comprising sliding means for enabling said means for limiting access to slide between said positions substantially along said linear direction.

23. An anti-scavenging apparatus in accordance with claim 21, further comprising pivoting means for enabling said means for limiting access to pivot between said positions.

24. An anti-scavenging apparatus in accordance with claim 21, further comprising means for stabilizing said means for limiting access in said first position.

* * * * *